US009914988B2

(12) United States Patent
Takashima et al.

(10) Patent No.: US 9,914,988 B2
(45) Date of Patent: Mar. 13, 2018

(54) HIGH-STRENGTH COLD-ROLLED STEEL SHEET WITH HIGH YIELD RATIO HAVING EXCELLENT FORMABILITY AND METHOD FOR PRODUCING THE SAME

(75) Inventors: Katsutoshi Takashima, Fukuyama (JP); Yuki Toji, Fukuyama (JP); Kohei Hasegawa, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 856 days.

(21) Appl. No.: 13/980,981

(22) PCT Filed: Nov. 30, 2011

(86) PCT No.: PCT/JP2011/078222

§ 371 (c)(1),
(2), (4) Date: Sep. 10, 2013

(87) PCT Pub. No.: WO2012/105126

PCT Pub. Date: Aug. 9, 2012

(65) Prior Publication Data

US 2013/0340898 A1 Dec. 26, 2013

(30) Foreign Application Priority Data

Jan. 31, 2011 (JP) ..... 2011-018191

(51) Int. Cl.

| | |
|---|---|
| ***C22C 38/04*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/12*** | (2006.01) |
| ***C22C 38/08*** | (2006.01) |
| ***C22C 38/14*** | (2006.01) |
| ***C22C 38/16*** | (2006.01) |
| ***C22C 38/26*** | (2006.01) |

(52) U.S. Cl.

CPC ..... *C21D 8/0263* (2013.01); *C21D 8/0226* (2013.01); *C21D 8/0236* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/26* (2013.01); *C21D 2211/005* (2013.01); *C21D 2211/008* (2013.01)

(58) Field of Classification Search

CPC ..... C22C 38/00; C22C 38/001; C22C 38/02; C22C 38/04; C22C 38/08; C22C 38/14; C22C 38/16; C22C 38/18; C22C 38/26; C21D 2211/005; C21D 9/46

USPC ..... 148/603

See application file for complete search history.

(56) References Cited

U.S. PATENT DOCUMENTS

| | | | | |
|---|---|---|---|---|
| 5,098,491 | A * | 3/1992 | Osawa | C22C 38/16 148/330 |
| 2007/0029015 | A1* | 2/2007 | Yoshinaga | C21D 6/005 148/533 |
| 2011/0024004 | A1* | 2/2011 | Azuma | C21D 8/0236 148/533 |

FOREIGN PATENT DOCUMENTS

| | | | |
|---|---|---|---|
| JP | 2005-264323 | A | 9/2005 |
| JP | 3793350 | B2 | 7/2006 |
| JP | 3873638 | B2 | 1/2007 |
| JP | 3887235 | B2 | 2/2007 |
| JP | 2007-197748 | A | 8/2007 |
| JP | 2008-106351 | A | 5/2008 |
| JP | 2008-156680 | A | 7/2008 |
| JP | 2008-174776 | A | 7/2008 |
| JP | 2009-174019 | A | 8/2009 |
| WO | WO2009/125874 | A | 10/2009 |

OTHER PUBLICATIONS

International Search Report dated Mar. 13, 2012, application No. PCT/JP2011/078222.

* cited by examiner

*Primary Examiner* — Colleen Dunn
*Assistant Examiner* — Anthony Liang
(74) *Attorney, Agent, or Firm* — RatnerPrestia

(57) ABSTRACT

Provided are a high-strength cold-rolled steel sheet having excellent formability, excellent ductility, excellent hole expansibility, and high yield ratio and a method for producing the same. The high-strength cold-rolled steel sheet contains 0.05% to 0.15% C, 0.10% to 0.90% Si, 1.0% to 2.0% Mn, 0.005% to 0.05% P, 0.0050% or less S, 0.01% to 0.10% Al, 0.0050% or less N, and 0.010% to 0.100% Nb, which are chemical components, on a mass basis, the balance being Fe and unavoidable impurities; has a microstructure which is a multi-phase structure containing 90% or more of a ferrite phase and 0.5% to less than 5.0% of a martensite phase on a volume fraction basis, the remainder being low-temperature transformation phases; and has a yield ratio of 70% or more.

10 Claims, No Drawings

HIGH-STRENGTH COLD-ROLLED STEEL SHEET WITH HIGH YIELD RATIO HAVING EXCELLENT FORMABILITY AND METHOD FOR PRODUCING THE SAME

CROSS REFERENCE TO RELATED APPLICATIONS

This application is the U.S. National Phase application of PCT International Application No. PCT/JP2011/078222, filed Nov. 30, 2011, and claims priority to Japanese Patent Application No. 2011-018191, filed Jan. 31, 2011, the disclosures of both applications being incorporated herein by reference in their entireties for all purposes.

FIELD OF THE INVENTION

The present invention relates to a high-strength cold-rolled steel sheet with high yield ratio having excellent formability and a method for producing the same and particularly relates to a high-strength steel sheet suitable for members for structural parts of automobiles and the like. The yield ratio (YR) is a value representing the ratio of the yield stress (YS) to the tensile strength (TS) and is given by YR=YS/TS.

BACKGROUND OF THE INVENTION

In recent years, regulations on $CO_2$ emissions have been tightened in awareness of environmental issues. In the automotive field, the improvement of fuel efficiency by automotive weight reduction is a big issue. Therefore, gauge reduction by applying high-strength steel sheets to automotive parts has been pursued. Steel sheets with a TS of 590 MPa or more are applied to parts for which steel sheets with a TS of 270 MPa to 440 MPa have been conventionally used.

The steel sheets with a TS of 590 MPa or more need to have properties being excellent in formability typified by ductility and stretch flange formability (hole expansibility) from the viewpoint of formability and also being high in impact energy absorbing capability. An increase in yield ratio is effective in order to enhance impact energy absorbing capability and it enables impact energy to be efficiently absorbed even with a small amount of deformation.

From the viewpoint of mechanisms for strengthening a steel sheet to achieve a tensile strength of 590 MPa or more, there is a method making use of hardening of a ferrite phase, which is a parent phase, and there is another one making use of a hard phase such as a martensite phase. As for hardening of a ferrite phase, precipitation-hardened high-strength steel sheets containing a carbide-forming element such as Nb can be produced at low cost because the amount of an alloying element necessary to achieve a predetermined strength is small.

For example, Patent Literature 1 discloses a method for producing a galvanized steel sheet, precipitation-hardened by the addition of Nb, having a tensile strength of 590 MPa or more and excellent resistance to secondary working embrittlement after press forming. Patent Literature 2 discloses a high-strength cold-rolled steel sheet, precipitation-hardened by the addition of Nb and Ti, having a tensile strength TS of 490 MPa to less than 720 MPa, a yield ratio of more than 0.70 to less than 0.92, excellent stretch flange formability, and excellent impact energy absorbing capability and also discloses a method for producing the same. Patent Literature 3 discloses a high-strength cold-rolled steel sheet, precipitation-hardened by the addition of one or both of Nb and Ti, having high yield ratio. This steel sheet has a microstructure containing recrystallized ferrite, unrecrystallized ferrite, and pearlite; a maximum tensile strength of 590 MPa or more; and a yield ratio of 0.70 or more.

On the other hand, as for a method making use a hard phase such as a martensite phase, for example, Patent Literature 4 discloses a dual-phase high-strength cold-rolled steel sheet having excellent dynamic deformability due to a multi-phase microstructure containing a primary phase which is ferrite, a secondary phase containing 3% to 50% martensite on a volume fraction basis, and other low-temperature transformation phases and also discloses a method for producing the same. Patent Literature 5 discloses a high-strength steel sheet having excellent stretch flange formability and crashworthiness. The high-strength steel sheet is composed of a ferrite phase which is a primary phase and a martensite phase which is a secondary phase, the martensite phase being a maximum grain size of 2 μm or less and an area fraction of 5% or more.

PATENT LITERATURE

PTL 1: Japanese Patent No. 3873638

PTL 2: Japanese Unexamined Patent Application Publication No. 2008-174776

PTL 3: Japanese Unexamined Patent Application Publication No. 2008-156680

PTL 4: Japanese Patent No. 3793350

PTL 5: Japanese Patent No. 3887235

SUMMARY OF THE INVENTION

Patent Literature 1 relates to a galvanized steel sheet and lacks description of the microstructure of a steel sheet in the present invention as described below. Furthermore, a steel sheet disclosed in Patent Literature 1 is insufficient in ductility from the viewpoint of formability.

For Patent Literature 2, since the content of Al in a steel sheet is less than 0.010%, the deoxidation of steel and the fixation of N by precipitation cannot be sufficiently carried out and the mass production of sound steel is difficult. In addition, there is a problem in that a variation in material quality, particularly local ductility, is large because O is contained and oxides are dispersed.

In Patent Literature 3, the reduction of ductility is suppressed by uniformly dispersing unrecrystallized ferrite. However, either ductility or hole expansibility sufficiently satisfying formability cannot be achieved because the microstructure of a steel sheet is different from that of the present invention as described below.

Patent Literature 4, which makes use of martensite, does not at all take into account hole expansibility as formability. Patent Literature 5 does not at all take ductility into account.

As described above, it has been difficult to enhance both of the ductility and the hole expansibility of high-strength steel sheets having high yield ratio.

The present invention aims to solve the problems in the conventional techniques and to provide a high-strength steel sheet having excellent formability, that is, excellent ductility and hole expansibility, and high yield ratio also, and a method for producing the same.

The inventors of the present invention have made intensive investigations and, as a result, have found that a high-strength cold-rolled steel sheet having a high yield ratio of 70% or more and excellent formability can be obtained by controlling the volume fraction of a martensite phase in the microstructure of a steel sheet in addition to by applying precipitation hardening using Nb.

In particular, the inventors have found that a high-yield ratio cold-rolled steel sheet having high strength and excellent formability can be obtained in such a manner that 0.010% to 0.100% Nb, which is highly effective on precipitation hardening being effective for high yield ratio and high strength, is added and the microstructure of a steel sheet is controlled such that the volume fraction of a ferrite phase which is a primary phase (first phase) is 90% or more and the volume fraction of a martensite phase which is a secondary phase ranges from 0.5% to less than 5.0%, thereby completing the present invention.

That is, the scope of embodiments of the present invention is as described below.

(1) A high-strength cold-rolled steel sheet with high yield ratio having excellent formability has a chemical composition which contains 0.05% to 0.15% C, 0.10% to 0.90% Si, 1.0% to 2.0% Mn, 0.005% to 0.05% P, 0.0050% or less S, 0.01% to 0.10% Al, 0.0050% or less N, and 0.010% to 0.100% Nb, on a mass basis, the balance being Fe and unavoidable impurities. The high-strength cold-rolled steel sheet has a microstructure which is a multi-phase structure containing 90% or more of a ferrite phase and 0.5% to less than 5.0% of a martensite phase on a volume fraction basis, the remainder being low-temperature transformation phases. The high-strength cold-rolled steel sheet has a yield ratio of 70% or more.

(2) The high-strength cold-rolled steel sheet specified in Item (1) contains Nb-containing precipitates having an average grain size of 0.10 μm or less.

(3) The high-strength cold-rolled steel sheet specified in Item (1) or (2) further contains at least one selected from the group consisting of 0.10% or less V and 0.10% or less Ti on a mass basis instead of a portion of the Fe component.

(4) The high-strength cold-rolled steel sheet specified in any one of Items (1) to (3) further contains at least one selected from the group consisting of 0.50% or less Cr, 0.50% or less Mo, 0.50% or less Cu, 0.50% or less Ni, and 0.0030% or less B on a mass basis instead of a portion of the Fe component.

(5) The high-strength cold-rolled steel sheet specified in any one of Items (1) to (4) has a tensile strength of 590 MPa or more.

(6) A method for producing a high-strength cold-rolled steel sheet with high yield ratio having excellent formability, the method comprising:

hot-rolling a steel slab having a chemical composition containing 0.05% to 0.15% C, 0.10% to 0.90% Si, 1.0% to 2.0% Mn, 0.005% to 0.05% P, 0.0050% or less S, 0.01% to 0.10% Al, 0.0050% or less N, and 0.010% to 0.100% Nb, on a mass basis, the balance being Fe and unavoidable impurities, at a hot-rolling start temperature of 1,150° C. to 1,270° C. and a finishing delivery temperature of 830° C. to 950° C. to manufacture a hot-rolled steel sheet;

cooling the hot-rolled steel sheet;

then coiling the hot-rolled steel sheet in a temperature range of 450° C. to 650° C.;

pickling the hot-rolled steel sheet;

then cold rolling the hot-rolled steel sheet into a cold-rolled steel sheet;

then annealing the cold-rolled steel sheet, wherein heating is performed to a first heating temperature in a temperature range of 710° C. to 820° C. at a first average heating rate of 3° C./s to 30° C./s, soaking is performed at the first heating temperature for a soaking time of 30 s to 300 s, then cooling is performed to a first cooling temperature in a temperature range of 400° C. to 600° C. at a first average cooling rate of 3° C./s to 25° C./s, and then cooling is performed from the first cooling temperature to a room temperature at a second average cooling rate of 3° C./s or less; and then temper-rolling the cold-rolled steel sheet with an elongation of 0.3% to 2.0%.

(7) In the high-strength cold-rolled steel sheet-producing method specified in Item (6), the cooling subsequent to hot rolling is performed prior to coiling in such a manner that cooling is started within a first cooling time of 1 s after the end of hot rolling, rapid cooling to a second cooling temperature in a temperature range of 650° C. to 750° C. is performed at a third average cooling rate of 20° C./s or more, and air cooling is performed in a temperature range from the second cooling temperature to 650° C. for a second cooling time, of 2 s or more.

(8) In the high-strength cold-rolled steel sheet-producing method specified in Item (6) or (7), at least one selected from the group consisting of 0.10% or less V and 0.10% or less Ti are further contained on a mass basis instead of a portion of the Fe component.

(9) In the high-strength cold-rolled steel sheet-producing method according to specified in any one of Items (6) to (8), at least one selected from the group consisting of 0.50% or less Cr, 0.50% or less Mo, 0.50% or less Cu, 0.50% or less Ni, and 0.0030% or less B are further contained on a mass basis instead of a portion of the Fe component.

According to the present invention, a high-strength cold-rolled steel sheet with high yield ratio having excellent formability can be stably obtained by controlling the composition and microstructure of a steel sheet. The high-strength cold-rolled steel sheet has a tensile strength of 590 MPa or more, a yield ratio of 70% or more, a total elongation of 26.5% or more, and a hole expansion ratio of 60% or more.

DETAILED DESCRIPTION OF EMBODIMENTS OF THE INVENTION

The present invention will now be described in detail with reference to exemplary embodiments.

At first, reasons for limiting the composition (chemical components) of a high-strength cold-rolled steel sheet according to the present invention are described below. Hereinafter, the expression "%" for each component refers to mass percent.

C: 0.05% to 0.15%

Carbon (C) is an element effective in strengthening steel sheets and, in particular, forms fine alloy carbides or alloy carbonitrides together with a carbide-forming element such as Nb to contribute to the strengthening of steel sheets. Furthermore, in the present invention, C is an element necessary to form a martensite phase which is a secondary phase and contributes to strengthening. In order to achieve this effect, 0.05% or more C needs to be added. On the other hand, when the content of C is more than 0.15%, spot weldability is reduced. Therefore, the upper limit of the C content is 0.15%. From the viewpoint of achieving better spot weldability, the C content is preferably 0.12% or less.

Si: 0.10% to 0.90%

Silicon (Si) is an element contributing to strengthening. Silicon has high work hardening ability and therefore it allows a reduction in ductility to be small relative to an increase in strength. Thus, silicon is also an element contributing to enhancing the balance between strength and ductility. Furthermore, Si reduces the difference in hardness between a ferrite phase and the secondary phase, which is hard, by the solid solution hardening of the ferrite phase and therefore contributes to an increase in hole expansibility. In order to achieve this effect, the content of Si needs to be 0.10% or more. When the enhancement of the strength-ductility balance is taken more important, the Si content is preferably 0.20% or more. However, when the Si content is more than 0.90%, the chemical conversion treatment property is reduced. Therefore, the Si content is preferably 0.90% or less and more preferably 0.80% or less.

Mn: 1.0% to 2.0%

Manganese (Mn) is an element that contributes to strengthening by solid solution hardening and by forming the secondary phase. In order to achieve this effect, the content of Mn needs to be 1.0% or more. However, when Mn content is more than 2.0%, a reduction in formability is significant. Therefore, the content thereof is 2.0% or less.

P: 0.005% to 0.05%

Phosphorus (P) is an element that contributes to strengthening by solid solution hardening. In order to achieve this effect, the content of P needs to be 0.005% or more. When the P content is more than 0.05%, P significantly segregates at grain boundaries to embrittle the grain boundaries and is likely to centrally segregate. Therefore, the upper limit of the P content is 0.05%.

S: 0.0050% or Less

When the content of sulfur (S) is large, a large amount of sulfides such as MnS are produced and local ductility typified by stretch flange formability is reduced. Therefore, the upper limit of the S content is 0.0050% and is preferably 0.0030% or less. The lower limit of the S content need not be particularly limited. However, an extreme reduction in S content causes an increase in steelmaking cost. Therefore, the lower limit of the S content is preferably 0.0005%.

Al: 0.01% to 0.10%

Aluminium (Al) is an element necessary for deoxidation. In order to achieve this effect, the content of Al needs to be 0.01% or more. However, even if the Al content exceeds 0.10%, the increase of this effect is not recognized. Therefore, the upper limit of the Al content is 0.10%.

N: 0.0050% or Less

Nitrogen (N), as well as C, reacts with Nb to produce an alloy nitride or an alloy carbonitride and contributes to strengthening. However, nitrides are likely to be produced at relatively high temperature, therefore are likely to be coarse, and relatively less contribute to strengthening as compared with carbides. That is, it is advantageous for strengthening that the amount of N is reduced and alloy carbides are much produced. From this viewpoint, the content of N is 0.0050% or less and is preferably 0.0030% or less.

Nb: 0.010% to 0.100%

Niobium (Nb) reacts with C and N to produce a carbide and a carbonitride and contributes to an increase in yield ratio and strengthening. In order to achieve this effect, the content of Nb needs to be 0.010% or more. However, when the Nb content is more than 0.100%, a reduction in formability is significant. Therefore, the upper limit of the Nb content is 0.100%.

In the present invention, in addition to the above fundamental components, arbitrary components below may be added in predetermined amounts as required.

V: 0.10% or Less

Vanadium (V), as well as Nb, can form fine carbonitrides to contribute to an increase in strength and therefore is an element which may be contained as required. Even if the content of V is more than 0.10%, a strength-increasing effect due to a surplus exceeding 0.10% is small and an increase in alloying cost is caused. Therefore, the V content is 0.10% or less. When V is contained in order to exhibit such a strength-increasing effect, the content thereof is preferably 0.01% or more.

Ti: 0.10% or Less

Titanium (Ti), as well as Nb, can form fine carbonitrides to contribute to an increase in strength and therefore is an element which may be contained as required. When the content of Ti is more than 0.10%, a reduction in formability is significant. Therefore, the Ti content is 0.10% or less. When V is contained in order to exhibit a strength-increasing effect, the content thereof is preferably 0.005% or more.

Cr: 0.50% or Less

Chromium (Cr) enhances hardenability and produces the secondary phase to contribute to strengthening and therefore is an element which may be added as required. Even if the content of Cr is more than 0.50%, an increase in effect is not recognized. Therefore, the Cr content is 0.50% or less. When Cr is contained in order to exhibit strengthening, the content thereof is preferably 0.10% or more.

Mo: 0.50% or Less

Molybdenum (Mo) enhances hardenability, produces the secondary phase to contribute to strengthening, further produces a carbide to contribute to strengthening, and therefore is an element which may be added as required. Even if the content of Mo is more than 0.50%, an increase in effect is not recognized. Therefore, the Mo content is 0.50% or less. When Mo is contained in order to exhibit strengthening, the content thereof is preferably 0.05% or more.

Cu: 0.50% or Less

Copper (Cu) contributes to strengthening by solid solution hardening, enhances hardenability, produces the secondary phase to contribute to strengthening, and therefore is an element which may be added as required. Even if the content of Cu is more than 0.50%, an increase in effect is not recognized and surface defects due to Cu are likely to be caused. Therefore, the Cu content is 0.50% or less. When Cu is contained in order to exhibit the above effect, the content thereof is preferably 0.05% or more.

Ni: 0.50% or Less

Nickel (Ni), as well as Cu, contributes to strengthening by solid solution hardening, enhances hardenability, and produces the secondary phase to contribute to strengthening. When Ni is added together with Cu, Ni has the effect of suppressing surface defects due to Cu and therefore is an element which may be added as required. Even if the content of Ni is more than 0.50%, an increase in effect is not recognized. Therefore, the Ni content is 0.50% or less. When Ni is contained in order to exhibit the above effect, the content thereof is preferably 0.05% or more.

B: 0.0030% or Less

Boron (B) enhances hardenability, produces the secondary phase to contribute to strengthening, and therefore is an element which may be added as required. Even if the content of B is more than 0.0030%, an increase in effect is not recognized. Therefore, the B content is 0.0030% or less. When B is contained in order to exhibit the above effect, the content thereof is preferably 0.0005% or more.

The remainder other than the above chemical components is Fe and unavoidable impurities.

The microstructure of the high-strength cold-rolled steel sheet according to an embodiment of the present invention is described below in detail.

Secondly, the microstructure of the steel sheet is a multi-phase structure which contains 90% or more of the ferrite phase, which is the primary phase (first phase), and 0.5% to less than 5.0% of the martensite phase, which is the secondary phase, on a volume fraction basis, the remainder being low-temperature transformation phases. The term "volume fraction" as used herein refers to the volume fraction with respect to the whole of the steel sheet. This applies to the following.

A main mechanism for strengthening the cold-rolled steel sheet according to the present invention is precipitation hardening by the precipitation of carbides. In addition, the strength can be increased by the martensite phase, which is a hard secondary phase.

When the volume fraction of the ferrite phase is less than 90%, many hard secondary phases such as the martensite phase and a pearlite phase are present and therefore many sites having large differences in hardness from the ferrite phase, which is soft, are present; hence, hole expansibility is reduced. Therefore, the volume fraction of the ferrite phase is 90% or more and is preferably 93% or more. The term "ferrite phase" as used herein refers to all ferrite phases including a recrystallized ferrite phase and an unrecrystallized ferrite phase.

When the volume fraction of the martensite phase is less than 0.5%, the martensite phase has little effect on the strength. Therefore, the volume fraction of the martensite phase is 0.5% or more. However, when the volume fraction of the martensite phase is 5.0% or more, the martensite phase, which is hard, induces mobile dislocations in the surrounding ferrite phase and therefore causes a reduction in yield ratio and a reduction in hole expansibility. Therefore, the volume fraction of the martensite phase is less than 5.0% and is preferably 3.5% or less.

The remainder microstructure other than the ferrite phase and the martensite phase may be a mixed microstructure containing one or more low-temperature transformation phases selected from the group consisting of the pearlite phase, a bainite phase, a retained austenite (γ) phase and the like. From the viewpoint of formability, the volume fraction of the remainder microstructure other than the ferrite phase and the martensite phase is preferably 5.0% or less in total.

The high-strength cold-rolled steel sheet according to the present invention preferably contains Nb-containing precipitates with an average grain size of 0.10 μm or less. This is because when the average grain size of the Nb-containing precipitates is 0.10 μm or less, the strain around the Nb-containing precipitates effectively acts as a resistance to the migration of dislocations, and the Nb-containing precipitates can contribute to the strengthening of steel.

Then, an embodiment of a method for producing the high-strength cold-rolled steel sheet according to the present invention is described below.

Below is an embodiment of the method for producing the high-strength cold-rolled steel sheet according to the present invention. The present invention is not limited to the method described below. Another producing method may be used if the high-strength cold-rolled steel sheet according to the present invention can be obtained.

The high-strength cold-rolled steel sheet according to the present invention can be produced in such a manner that a steel slab having the same composition as the composition of the steel sheet described above is hot-rolled at a hot-rolling start temperature of 1,150° C. to 1,270° C. and a finishing delivery temperature of 830° C. to 950° C., is cooled, is coiled at a temperature in the range of 450° C. to 650° C., is pickled, is cold-rolled, and the resultant cold-rolled steel sheet is heated to a first heating temperature in the range of 710° C. to 820° C. at a first average heating rate of 3° C./s to 30° C./s, is soaked at the first heating temperature for a soaking time of 30 s to 300 s, is cooled to a first cooling temperature in the range of 400° C. to 600° C. at a first average cooling rate of 3° C./s to 25° C./s, is annealed on the condition that cooling from the first cooling temperature to room temperature is performed at a second average cooling rate of 3° C./s or less, and is then temper-rolled with an elongation of 0.3% to 2.0%.

In a hot rolling step, it is preferred that hot rolling of the steel slab is started at a temperature of 1,150° C. to 1,270° C. without reheating after casting or the steel slab is reheated to a temperature of 1,150° C. to 1,270° C. and is then the hot rolling is stated. The steel slab used is preferably produced by a continuous casting process in order to prevent the macro-segregation of components and may also be produced by an ingot-making process or a thin slab-casting process. A preferred condition for the hot rolling step is that the steel slab is hot-rolled at a hot-rolling start temperature of 1,150° C. to 1,270° C. In the present invention, the following processes can be used without any problems: a conventional process in which after being produced, the steel slab is cooled to room temperature once and is then reheated and an energy-saving process such as direct hot charge rolling or direct rolling in which the steel slab is charged into a furnace as heated without cooling and is then rolled, the steel slab is heat-retained and is then immediately rolled, or the steel slab is rolled directly after casting.

[Hot Rolling Step]

Hot-Rolling Start Temperature: 1,150° C. to 1,270° C.

A hot-rolling start temperature of lower than 1,150° C. causes an increase in rolling load to reduce in productivity and therefore is not preferred. A hot-rolling start temperature of higher than 1,270° C. brings only an increase in heating cost. Therefore, the hot-rolling start temperature is preferably 1,150° C. to 1,270° C.

Finishing Delivery Temperature: 830° C. to 950° C.

Hot rolling enhances the elongation and hole expansibility of the annealed steel sheet through the homogenization of the microstructure of the steel sheet and the reduction in anisotropy of the material and therefore needs to be ended in an austenite single-phase zone. Therefore, the finishing delivery temperature is 830° C. or higher. However, when the finishing delivery temperature is higher than 950° C., a hot-rolled microstructure is coarse and properties may possibly be impaired after annealing. Therefore, the finishing delivery temperature is 830° C. to 950° C.

Cooling conditions after finish rolling are not particularly limited. Cooling is preferably performed under cooling conditions below.

Cooling Conditions After Finish Rolling

Cooling conditions after finish rolling are preferably as follows: cooling is started within a first cooling time of 1 s after the end of hot rolling, rapid cooling to a second cooling temperature in the range of 650° C. to 750° C. is performed at a third average cooling rate of 20° C./s or more, and air cooling is then performed in a temperature range from the second cooling temperature to 650° C. for a second cooling time of 2 s or more.

Ferrite transformation is promoted and fine, stable alloy carbides are precipitated by rapid cooling to a ferrite zone after the end of hot rolling, whereby high-strengthening can be accomplished. Keeping (maintaining) a hot-rolled steel sheet at a high temperature after the end of hot rolling causes the coarsening of precipitates. Therefore, it is preferred that cooling is started within 1 s after the end of hot rolling and rapid cooling to a second cooling temperature in the range of 650° C. to 750° C. is performed at a third average cooling rate of 20° C./s or more. In the ferrite zone, precipitates are likely to be coarsened at high temperature and precipitation is suppressed at low temperature. Therefore, from the viewpoint of promoting the precipitation of the ferrite phase without coarsening, air cooling is preferably performed in a temperature range from the second cooling temperature to 650° C. for a second cooling time of 2 s or more (however, when the second cooling temperature is 650° C., 650° C. should be maintained).

Coiling Temperature: 450° C. to 650° C.

When the coiling temperature is higher than 650° C., precipitates, such as alloy carbides, produced in the course of cooling subsequent to hot rolling are significantly coarsened. Therefore, the upper limit of the coiling temperature is 650° C. However, when the coiling temperature is lower than 450° C., the bainite phase and the martensite phase, which are hard, are excessively produced. This causes an increase in cold-rolling load to inhibit productivity. Therefore, the lower limit of the coiling temperature is 450° C.

[Pickling Step]

A pickling step is performed subsequently to the hot rolling step, whereby scales are removed from a surface layer of the hot-rolled steel sheet. The pickling step is not particularly limited and may be performed in accordance with common practice.

[Cold Rolling Step]

The pickled hot-rolled steel sheet is subjected to a cold rolling step so as to have a predetermined sheet thickness. The cold rolling step is not particularly limited and may be performed in accordance with common practice.

[Annealing Step]

An annealing step is performed on the following conditions: after heating to a first heating temperature I the range of 710° C. to 820° C. is performed at a first average heating rate of 3° C./s to 30° C./s and soaking is performed at the first heating temperature for a soaking time of 30 s to 300 s, cooling to a first cooling temperature in the range of 400° C. to 600° C. is performed at a first average cooling rate of 3° C./s to 25° C./s and cooling from the first cooling temperature to room temperature is performed at a second average cooling rate of 3° C./s or less. In the annealing step, it is important for strengthening that the recrystallization of a ferrite microstructure is promoted and the dissolution or coarsening of precipitates is suppressed. In order to form such a microstructure, it is appropriate that recrystallization is sufficiently promoted during heating, then a portion is transformed into the austenite phase by soaking in a two-phase zone, a low-temperature transformation phase including 0.5% to less than 5.0% of the martensite phase as a secondary phase and including the pearlite phase, the bainite phase, and the retained austenite (γ) phase is produced in a small amount during cooling. Therefore, annealing is performed under conditions below.

First Average Heating Rate: 3° C./s to 30° C./s

Material quality can be stabilized in such a manner that recrystallization is sufficiently promoted in the ferrite zone prior to heating to the two-phase zone. When the first average heating rate is more than 30° C./s and heating is rapid, recrystallization is unlikely to be promoted. Therefore, the upper limit of the first average heating rate is 30° C./s. However, when the first average heating rate is less than 3° C./s, the ferrite grains are coarsened and the strength is reduced. Therefore, the lower limit of the first average heating rate is 3° C./s.

First Heating Temperature: 710° C. to 820° C.

When the first heating temperature is lower than 710° C., even the first average heating rate described above allows many unrecrystallized microstructures to remain and the formability is reduced. Therefore, the lower limit of the first heating temperature is 710° C. However, when the first heating temperature is higher than 820° C., precipitates are coarsened and the strength is reduced. Therefore, the upper limit of the first heating temperature is 820° C. and is preferably 800° C. or lower.

Soaking Time: 30 s to 300 s

In order to promote recrystallization and to transform a portion of a steel microstructure into austenite at the first heating temperature described above, the soaking time needs to be 30 s or more. However, when the soaking time is more than 300 s, ferrite grains are coarsened and the strength is reduced. Therefore, the soaking time needs to be 300 s or less.

Cooling Step

Cooling is performed in such a manner that cooling to a first cooling temperature in the range of 400° C. to 600° C. is performed at a first average cooling rate of 3° C./s to 25° C./s and cooling from the first cooling temperature to room temperature is then performed at a second average cooling rate of 3° C./s or less.

In order to control the volume fraction of the ferrite phase to 90% or more and the volume fraction of the martensite phase to 0.5% to less than 5.0%, cooling from the first heating temperature to the first cooling temperature is performed at a first average cooling rate of 3° C./s to 25° C./s. When the first cooling temperature is higher than 600° C., the volume fraction of the martensite phase is less than 0.5%. However, when the first cooling temperature is lower than 400° C., the volume fraction of the martensite phase is increased to 5.0% or more, further the bainite phase and the retained austenite (γ) phase are produced, and the volume fraction of the ferrite phase is reduced to less than 90%. Therefore, the first cooling temperature ranges from 400° C. to 600° C. When the first average cooling rate is less than 3° C./s, the volume fraction of the martensite phase is reduced to less than 0.5%. Therefore, the first average cooling rate is 3° C./s or more. However, when the first average cooling rate is more than 25° C./s, the bainite phase and the retained γ phase are produced and the volume fraction of the ferrite phase is reduced to less than 90%. Therefore, the first average cooling rate is 25° C./s or less.

Cooling from the first cooling temperature to room temperature is performed at a second average cooling rate of 3° C./s or less. When the second average cooling rate is more than 3° C./s, the volume fraction of the martensite phase is increased to 5.0% or more. Therefore, the average cooling rate from the first cooling temperature to room temperature is 3° C./s or less.

[Temper Rolling Step]

If the yield point or the yield elongation is induced, a large variation in strength, particularly yield stress YS, may possibly be caused. Therefore, temper rolling is preferably performed.

Elongation (Rolling Reduction) by Temper Rolling: 0.3% to 2.0%

In order not to induce the yield point or the yield elongation, temper rolling is preferably performed with an elongation of 0.3% or more. However, when the elongation is more than 2.0%, the significant increase of the above effect is not recognized and the ductility may possibly be reduced. Therefore, the upper limit of the elongation is preferably 2.0%.

The high-strength cold-rolled steel'sheet according to the present invention is not limited to any high-strength cold-rolled steel sheet produced by the above producing method but include various kinds of surface-treated steel sheets which are surface-treated after an annealing step. Examples of the high-strength cold-rolled steel sheet include galvanized steel sheets produced by galvanizing subsequent to an annealing step and galvannealed steel sheets produced by alloying treatment after galvanizing.

Those described above are exemplary embodiments of the present invention. Various modifications can be made within the claimed scope.

EXAMPLES

Examples of the present invention are described below.

Steels having a composition shown in Table 1 were produced by melting and were then cast, whereby steel slabs with a thickness of 230 mm were produced. Each of the slabs was hot-rolled at a hot-rolling start temperature of 1,200° C. and a finishing delivery temperature (FDT) shown in Table 2, whereby a hot-rolled steel sheet with a thickness of 3.2 mm was obtained. The hot-rolled steel sheet was cooled within a first cooling time of 0.1 s after the end of hot rolling, was quenched to a second cooling temperature shown in Table 2 at a third average cooling rate shown in Table 2, was air-cooled in a temperature range from the second cooling temperature to 650° C. for a second cooling time of 2.5 s, and was then coiled at a coiling temperature (CT) shown in Table 2.

After being pickled, the hot-rolled steel sheet was cold-rolled into a cold-rolled steel sheet with a thickness of 1.4 mm. The cold-rolled steel sheet was then heated to a first heating temperature shown in Table 2 at a first average heating rate shown in Table 2, was soaked at the first heating temperature for a soaking time shown in Table 2, was cooled to a first cooling temperature shown in Table 2 at a first average cooling rate shown in Table 2, was annealed by cooling from the first cooling temperature to room temperature at a second average cooling rate shown in Table 2, and was then skin-pass-rolled (temper-rolled) with an elongation (rolling reduction) of 0.7%, whereby a high-strength cold-rolled steel sheet was produced.

JIS No. 5 tensile specimens were taken from nine sites, that is, a widthwise central position and two one-quarter width positions in each of a longitudinal nose section, central section, and tail section of the produced steel sheet perpendicularly to the rolling direction thereof and were measured for yield stress (YS), tensile strength (TS), elongation (EL), and yield ratio (YR) by a tensile test (JIS Z 2241 (1998)). Steel sheets with good ductility, that is, an elongation of 26.5% or more and steel sheets with a high yield ratio, that is, a YR of 70% or more were made.

For hole expansibility, each specimen was measured for hole expansion ratio λ (%) in accordance with The Japan Iron and Steel Federation standards (JFS T1001 (1996)) in such a manner that a hole with a diameter of 10 mm ϕ was punched in the specimen with a clearance of 12.5%, the specimen was set in a testing machine such that burrs were on the die side, and the hole was then shaped with a 60° conical punch. Those having a λ (%) of 60% or more were judged to be steel sheets having good hole expansibility.

For the microstructure of each steel sheet, a cross section (a position at a depth equal to one-quarter of the thickness of the steel sheet) of the steel sheet in the rolling direction was etched using a 3% nital reagent (3% nitric acid+ethanol), was observed with an optical microscope with a magnification of 500× to 1,000× and (scanning and transmission) electron microscopes with a magnification of 1,000× to 100,000×, and was photographed and the volume fraction of a ferrite phase and the volume fraction (%) of a martensite phase were determined using an obtained photograph of the microstructure. Each of 12 fields of view was observed and was measured for area fraction by a point-counting method (according to ASTM E562-83 (1988)) and the area fraction was defined as the volume fraction. The ferrite phase is a slightly black contrast region. The martensite phase is a white contrast region.

For the remainder low-temperature transformation phases, a pearlite phase and a bainite phase can be identified by observation using the optical microscope or the (either scanning or transmission) electron microscopes. The pearlite phase is a lamellar structure containing plate-like ferrite phases and cementite are alternately arranged. The bainite phase is a structure containing cementite and a plate-like bainitic ferrite phase which is higher in dislocation density than a polygonal ferrite phase.

The presence of a retained austenite phase was determined as follows: on a surface obtained by polishing off one-quarter of the steel sheet thickness from a surface layer, the integrated intensities of diffraction lines from the {200} plane, {211} plane, and {220} plane of a ferrite phase of iron and the {200} plane, {220} plane, and {311} plane of an austenite phase of iron were measured at an acceleration voltage of 50 keV by X-ray diffractometry (an instrument, RINT 2200, produced by Rigaku Corporation) using the Mo Kα line as a radiation source; the volume fraction of the retained austenite phase was determined from these measurements by calculation formulae described in "X-ray diffractometry handbook", Rigaku Corporation, 2000, pp. 26 and 62-64; and the retained austenite phase was judged to be present or absent when the volume fraction was 1% or more or less than 1%, respectively.

A method for measuring the average grain size of Nb-containing precipitates (carbides) was as follows: ten fields of view of a thin film prepared from each obtained steel sheet were observed with a transmission electron microscope (TEM) (a photograph enlarged to a magnification of 500,000×) and the average grain size of each precipitated carbide was determined. When the carbides were spherical, the diameter thereof was defined as the average grain size. When the carbides were elliptical, the major axis a of each carbide and a minor axis b perpendicular to the major axis were measured and the square root of the product a×b of the major axis a and the minor axis b was defined as the average grain size.

Table 2 shows measured tensile properties and hole expansibility. As is clear from results shown in Table 2, all inventive examples exhibit a steel sheet microstructure in which the volume fraction of a ferrite phase which is a primary phase is 90% or more and a martensite phase which is a secondary phase is 0.5% to less than 5.0%. This results in that a tensile strength of 590 MPa or more and a yield ratio of 70% or more are ensured and good formability including a total elongation of 26.5% or more and a hole expansion ratio of 60% or more is obtained.

TABLE 1

(Mass percent)

| | Chemical composition | | | | | | | | | |
|---|---|---|---|---|---|---|---|---|---|---|
| Steel | C | Si | Mn | P | S | Al | N | Nb | Other components | Remarks |
| A | 0.13 | 0.88 | 1.3 | 0.02 | 0.002 | 0.02 | 0.002 | 0.034 | — | Adequate steel |
| B | 0.11 | 0.71 | 1.4 | 0.01 | 0.003 | 0.02 | 0.003 | 0.035 | — | Adequate steel |
| C | 0.07 | 0.50 | 1.7 | 0.01 | 0.002 | 0.03 | 0.003 | 0.045 | — | Adequate steel |
| D | 0.10 | 0.34 | 1.5 | 0.02 | 0.003 | 0.02 | 0.003 | 0.059 | — | Adequate steel |
| E | 0.07 | 0.65 | 1.6 | 0.01 | 0.002 | 0.02 | 0.003 | 0.055 | — | Adequate steel |
| F | 0.11 | 0.43 | 1.8 | 0.01 | 0.002 | 0.03 | 0.002 | 0.015 | — | Adequate steel |
| G | 0.13 | 0.61 | 1.4 | 0.02 | 0.003 | 0.02 | 0.003 | 0.041 | — | Adequate steel |
| H | 0.13 | 0.25 | 2.0 | 0.02 | 0.002 | 0.02 | 0.003 | 0.043 | — | Adequate steel |
| I | 0.08 | 0.50 | 1.5 | 0.02 | 0.003 | 0.02 | 0.003 | 0.045 | — | Adequate steel |
| J | 0.09 | 0.45 | 1.6 | 0.01 | 0.003 | 0.02 | 0.003 | 0.033 | — | Adequate steel |
| K | 0.09 | 0.40 | 1.7 | 0.01 | 0.003 | 0.02 | 0.003 | 0.030 | — | Adequate steel |
| L | 0.08 | 0.35 | 1.6 | 0.02 | 0.003 | 0.03 | 0.003 | 0.015 | V: 0.05 | Adequate steel |
| M | 0.06 | 0.25 | 1.5 | 0.02 | 0.003 | 0.03 | 0.003 | 0.012 | Ti: 0.05 | Adequate steel |
| N | 0.11 | 0.25 | 1.2 | 0.02 | 0.003 | 0.03 | 0.003 | 0.035 | Cr: 0.25 | Adequate steel |
| O | 0.10 | 0.34 | 1.1 | 0.02 | 0.003 | 0.03 | 0.003 | 0.035 | Mo: 0.10 | Adequate steel |
| P | 0.08 | 0.26 | 1.4 | 0.02 | 0.003 | 0.03 | 0.003 | 0.025 | Cu: 0.10 | Adequate steel |
| Q | 0.07 | 0.41 | 1.3 | 0.02 | 0.002 | 0.02 | 0.004 | 0.030 | Ni: 0.10 | Adequate steel |
| R | 0.09 | 0.45 | 1.2 | 0.02 | 0.003 | 0.03 | 0.003 | 0.050 | B: 0.0015 | Adequate steel |
| S | 0.18 | 0.44 | 1.2 | 0.03 | 0.004 | 0.04 | 0.003 | 0.033 | — | Comparative steel |
| T | 0.14 | 0.05 | 2.4 | 0.02 | 0.003 | 0.03 | 0.003 | 0.005 | — | Comparative steel |
| U | 0.07 | 1.10 | 1.5 | 0.02 | 0.003 | 0.02 | 0.003 | 0.043 | — | Comparative steel |
| V | 0.03 | 0.22 | 2.3 | 0.02 | 0.003 | 0.03 | 0.003 | 0.029 | — | Comparative steel |
| W | 0.14 | 0.65 | 0.8 | 0.02 | 0.003 | 0.03 | 0.004 | 0.037 | — | Comparative steel |
| X | 0.09 | 0.05 | 2.8 | 0.01 | 0.003 | 0.03 | 0.003 | 0.008 | — | Comparative steel |

Underlined values are outside the scope of the present invention.

TABLE 2

| | | Hot rolling conditions | | | | Annealing conditions | | | | | | Tensile properties | | | | | Steel steet microstructure | | | | |
|---|---|---|---|---|---|---|---|---|---|---|---|---|---|---|---|---|---|---|---|---|---|
| Sample No. | Steel | FDT ° C. | Second cooling temperature ° C. | Third average cooling rate ° C./s | CT ° C. | First average heating rate ° C./s | First heating temperature ° C. | Soaking time s | First cooling temperature ° C. | First average cooling rate ° C./s | Second average cooling rate ° C./s | YS MPa | TS MPa | EL % | YR % | Hole expansion ratio λ % | Volume fraction of ferrite phase (%) | Volume fraction of martensite phase (%) | Other low-temperature phases (*1) | Average grain size of Nb-containing precipitates (μm) | Remarks |
| 1 | A | 890 | 700 | 20 | 600 | 10 | 750 | 120 | 500 | 5 | 0.5 | 433 | 615 | 28.4 | 70 | 75 | 95 | 2.8 | P, B, RA | 0.04 | Inventive example |
| 2 | B | 890 | 700 | 20 | 600 | 10 | 800 | 120 | 500 | 10 | 0.5 | 425 | 602 | 28.8 | 71 | 65 | 94 | 2.5 | P, B, RA | 0.03 | Inventive example |
| 3 | C | 860 | 700 | 20 | 540 | 10 | 760 | 200 | 480 | 5 | 0.3 | 478 | 625 | 29.2 | 76 | 61 | 95 | 2.9 | P, B, RA | 0.05 | Inventive example |
| 4 | D | 840 | 700 | 20 | 500 | 10 | 760 | 120 | 480 | 5 | 0.7 | 503 | 610 | 27.2 | 82 | 78 | 96 | 0.9 | P | 0.06 | Inventive example |
| 5 | E | 890 | 700 | 20 | 600 | 10 | 760 | 120 | 500 | 7 | 1.2 | 456 | 643 | 26.8 | 71 | 65 | 95 | 1.3 | P | 0.07 | Inventive example |
| 6 | F | 890 | 700 | 20 | 630 | 10 | 800 | 30 | 530 | 15 | 1.0 | 437 | 620 | 27.8 | 70 | 60 | 95 | 2.2 | P, B, RA | 0.09 | Inventive example |
| 7 | G | 860 | 700 | 20 | 500 | 5 | 760 | 60 | 470 | 13 | 0.9 | 491 | 635 | 27.3 | 77 | 67 | 97 | 1.4 | P | 0.08 | Inventive example |
| 8 | H | 860 | 700 | 20 | 580 | 8 | 760 | 120 | 500 | 5 | 0.5 | 433 | 593 | 28.1 | 73 | 71 | 95 | 2.9 | P, B, RA | 0.07 | Inventive example |
| 9 | I | 890 | 700 | 20 | 540 | 10 | 760 | 120 | 500 | 4 | 0.3 | 470 | 601 | 29.3 | 78 | 72 | 94 | 1.5 | P | 0.03 | Inventive example |
| 10 | I | 890 | 700 | 20 | 540 | 5 | 720 | 160 | 500 | 5 | 0.5 | 446 | 595 | 28.9 | 75 | 64 | 95 | 1.9 | P, B, RA | 0.08 | Inventive example |
| 11 | I | 890 | 700 | 20 | 540 | 20 | 760 | 120 | 500 | 5 | 0.5 | 488 | 623 | 26.8 | 78 | 65 | 96 | 2.6 | P, B, RA | 0.05 | Inventive example |
| 12 | I | 890 | 700 | 20 | 540 | 10 | 740 | 120 | 500 | 5 | 0.5 | 482 | 608 | 27.9 | 79 | 78 | 97 | 1.8 | P | 0.05 | Inventive example |
| 13 | I | 890 | 700 | 20 | 540 | 10 | 820 | 120 | 500 | 7 | 0.5 | 467 | 592 | 29.1 | 79 | 63 | 95 | 2.4 | P, B, RA | 0.10 | Inventive example |
| 14 | J | 890 | 700 | 20 | 540 | 10 | 750 | 120 | 500 | 5 | 0.5 | 477 | 605 | 27.1 | 79 | 78 | 97 | 1.1 | P | 0.05 | Inventive example |
| 15 | J | 890 | 750 | 20 | 620 | 10 | 760 | 150 | 500 | 5 | 1.0 | 442 | 619 | 29.3 | 71 | 65 | 96 | 2.5 | P, B, RA | 0.05 | Inventive example |
| 16 | J | 890 | 700 | 20 | 540 | 10 | 800 | 120 | 460 | 10 | 1.0 | 471 | 593 | 28.1 | 79 | 105 | 97 | 0.8 | P | 0.08 | Inventive example |
| 17 | J | 890 | 700 | 20 | 540 | 8 | 780 | 150 | 400 | 25 | 0.5 | 455 | 592 | 27.3 | 77 | 85 | 96 | 1.6 | P | 0.06 | Inventive example |
| 18 | K | 860 | 650 | 20 | 450 | 10 | 780 | 120 | 500 | 5 | 3.0 | 466 | 610 | 26.9 | 76 | 72 | 97 | 1.8 | P | 0.06 | Inventive example |
| 19 | K | 860 | 700 | 20 | 500 | 10 | 750 | 160 | 600 | 3 | 1.0 | 465 | 603 | 29.5 | 77 | 61 | 96 | 2.1 | P, B, RA | 0.05 | Inventive example |
| 20 | K | 860 | 700 | 20 | 460 | 5 | 740 | 200 | 550 | 4 | 2.0 | 443 | 598 | 28.8 | 74 | 62 | 97 | 1.8 | P | 0.04 | Inventive example |

TABLE 2-continued

| | | Hot rolling conditions | | | | Annealing conditions | | | | | | Tensile properties | | | | | Steel steet microstructure | | | | |
|---|---|---|---|---|---|---|---|---|---|---|---|---|---|---|---|---|---|---|---|---|---|
| Sample No. | Steel | FDT ° C. | Second cooling temperature ° C. | Third average cooling rate ° C./s | CT ° C. | First average heating rate ° C./s | First heating temperature ° C. | Soaking time s | First cooling temperature ° C. | First average cooling rate ° C./s | Second average cooling rate ° C./s | YS MPa | TS MPa | EL % | YR % | Hole expansion ratio λ % | Volume fraction of ferrite phase (%) | Volume fraction of martensite phase (%) | Other low-temperature phases (*1) | Average grain size of Nb-containing precipitates (μm) | Remarks |
| 21 | K | 860 | 700 | 20 | 540 | 5 | 740 | 200 | 500 | 10 | 3.0 | 435 | 612 | 29.4 | 71 | 61 | 94 | 4.1 | B, RA | 0.06 | Inventive example |
| 22 | K | 860 | 700 | 20 | 540 | 5 | 740 | 200 | 450 | 20 | 1.0 | 446 | 632 | 30.1 | 71 | 60 | 90 | 4.9 | B, RA | 0.06 | Inventive example |
| 23 | L | 860 | 700 | 20 | 540 | 5 | 750 | 120 | 500 | 5 | 0.5 | 443 | 622 | 27.3 | 71 | 65 | 93 | 2.5 | P, B, RA | 0.06 | Inventive example |
| 24 | M | 860 | 700 | 20 | 540 | 5 | 750 | 120 | 500 | 5 | 0.5 | 465 | 613 | 26.5 | 76 | 81 | 97 | 0.9 | P | 0.05 | Inventive example |
| 25 | N | 860 | 700 | 20 | 540 | 5 | 750 | 120 | 500 | 5 | 0.5 | 433 | 603 | 28.8 | 72 | 68 | 93 | 2.3 | P, B, RA | 0.05 | Inventive example |
| 26 | O | 860 | 700 | 20 | 540 | 5 | 750 | 120 | 500 | 5 | 0.5 | 465 | 658 | 28.1 | 71 | 69 | 94 | 3.3 | P, B, RA | 0.06 | Inventive example |
| 27 | P | 860 | 700 | 20 | 540 | 5 | 750 | 120 | 500 | 5 | 0.5 | 477 | 609 | 27.5 | 78 | 76 | 94 | 1.3 | P | 0.04 | Inventive example |
| 28 | Q | 860 | 700 | 20 | 540 | 5 | 750 | 120 | 500 | 5 | 0.5 | 466 | 613 | 27.3 | 76 | 86 | 95 | 1.4 | P | 0.05 | Inventive example |
| 29 | R | 860 | 700 | 20 | 540 | 5 | 800 | 180 | 500 | 5 | 0.5 | 498 | 695 | 26.6 | 72 | 69 | 91 | 3.3 | B, RA | 0.08 | Inventive example |
| 30 | S | 890 | 700 | 20 | 540 | 10 | 750 | 120 | 500 | 5 | 0.5 | 425 | 640 | 30.3 | 66 | 58 | 89 | 5.0 | B, RA | 0.06 | Comparative example |
| 31 | T | 890 | 700 | 20 | 540 | 10 | 760 | 120 | 500 | 5 | 0.5 | 391 | 664 | 31.3 | 59 | 52 | 85 | 10.3 | B, RA | 0.05 | Comparative example |
| 32 | U | 890 | 700 | 20 | 540 | 10 | 760 | 120 | 500 | 5 | 0.5 | 402 | 652 | 28.0 | 62 | 52 | 89 | 5.3 | B, RA | 0.05 | Comparative example |
| 33 | V | 890 | 700 | 20 | 540 | 10 | 760 | 120 | 500 | 5 | 0.5 | 355 | 633 | 30.5 | 56 | 45 | 88 | 9.3 | B, RA | 0.05 | Comparative example |
| 34 | W | 890 | 700 | 20 | 540 | 10 | 760 | 120 | 500 | 5 | 0.5 | 405 | 675 | 29.7 | 60 | 65 | 91 | 6.9 | B, RA | 0.06 | Comparative example |
| 35 | X | 890 | 700 | 20 | 540 | 10 | 760 | 120 | 500 | 5 | 0.5 | 466 | 622 | 24.1 | 75 | 66 | 92 | 7.2 | B, RA | 0.08 | Comparative example |
| 36 | J | 1000 | 700 | 20 | 540 | 10 | 760 | 120 | 500 | 5 | 0.5 | 420 | 570 | 28.4 | 74 | 62 | 99 | 0.3 | P | 0.05 | Comparative example |
| 37 | J | 800 | 650 | 20 | 540 | 10 | 760 | 120 | 500 | 5 | 0.5 | 523 | 623 | 21.3 | 84 | 58 | 89 | 5.6 | B, RA | 0.06 | Comparative example |
| 38 | J | 890 | 750 | 20 | 690 | 10 | 760 | 120 | 500 | 5 | 0.5 | 415 | 577 | 27.2 | 72 | 64 | 98 | 0.4 | P | 0.19 | Comparative example |
| 39 | J | 890 | 650 | 20 | 400 | 10 | 760 | 120 | 500 | 5 | 0.5 | 545 | 686 | 21.3 | 79 | 50 | 88 | 5.4 | B, RA | 0.03 | Comparative example |
| 40 | J | 890 | 700 | 20 | 540 | 60 | 760 | 120 | 500 | 5 | 0.5 | 612 | 710 | 18.6 | 86 | 43 | 89 | 6.1 | B, RA | 0.09 | Comparative example |
| 41 | J | 890 | 700 | 20 | 540 | 1.5 | 760 | 120 | 500 | 5 | 0.5 | 390 | 578 | 24.1 | 67 | 64 | 97 | 0.4 | P | 0.15 | Comparative example |

TABLE 2-continued

| | | Hot rolling conditions | | | | Annealing conditions | | | | | | Tensile properties | | | | | Steel steet microstructure | | | | |
|---|---|---|---|---|---|---|---|---|---|---|---|---|---|---|---|---|---|---|---|---|---|
| Sample No. | Steel | FDT ° C. | Second cooling temperature ° C. | Third average cooling rate ° C./s | CT ° C. | First average heating rate ° C./s | First heating temperature ° C. | Soaking time s | First cooling temperature ° C. | First average cooling rate ° C./s | Second average cooling rate ° C./s | YS MPa | TS MPa | EL % | YR % | Hole expansion ratio λ % | Volume fraction of ferrite phase (%) | Volume fraction of martensite phase (%) | Other low-temperature phases (*1) | Average grain size of Nb-containing precipitates (μm) | Remarks |
| 42 | J | 890 | 700 | 20 | 540 | 10 | 600 | 120 | 500 | 5 | 0.5 | 632 | 790 | 14.5 | 80 | 42 | 86 | 8.6 | B, RA | 0.03 | Comparative example |
| 43 | J | 890 | 700 | 20 | 540 | 10 | 900 | 120 | 500 | 5 | 0.5 | 378 | 577 | 25.3 | 66 | 53 | 89 | 7.3 | B, RA | 0.24 | Comparative example |
| 44 | I | 890 | 700 | 20 | 540 | 10 | 760 | 10 | 500 | 5 | 0.5 | 532 | 682 | 19.1 | 78 | 40 | 85 | 9.6 | B, RA | 0.06 | Comparative example |
| 45 | I | 890 | 700 | 20 | 540 | 10 | 760 | 600 | 500 | 5 | 0.5 | 416 | 574 | 23.3 | 72 | 62 | 97 | 0.3 | P | 0.15 | Comparative example |
| 46 | K | 890 | 700 | 20 | 540 | 10 | 760 | 120 | 350 | 5 | 0.5 | 415 | 633 | 29.6 | 66 | 51 | 92 | 6.3 | B, RA | 0.05 | Comparative example |
| 47 | K | 890 | 700 | 20 | 540 | 10 | 760 | 120 | 650 | 5 | 0.5 | 435 | 586 | 24.5 | 74 | 75 | 98 | 0.2 | P | 0.06 | Comparative example |
| 48 | K | 890 | 700 | 20 | 540 | 10 | 760 | 120 | 500 | 1 | 0.5 | 445 | 554 | 25.3 | 80 | 70 | 98 | 0.1 | P | 0.12 | Comparative example |
| 49 | K | 890 | 700 | 20 | 540 | 10 | 760 | 120 | 500 | 35 | 0.5 | 403 | 621 | 28.2 | 65 | 53 | 91 | 7.8 | B, RA | 0.05 | Comparative example |
| 50 | K | 890 | 700 | 20 | 540 | 10 | 760 | 120 | 500 | 5 | 5.0 | 395 | 656 | 27.3 | 60 | 49 | 84 | 7.8 | B, RA | 0.05 | Comparative example |

Underlined values are outside the scope of the present invention.

(*1) In this table, P represents a pearlite phase, B represents a bainite phase, and RA represents a retained austenite phase.

According to the present invention, a high-strength cold-rolled steel sheet with high yield ratio having excellent formability can be stably obtained by controlling the composition and microstructure of a steel sheet. The high-strength cold-rolled steel sheet has a tensile strength of 590 MPa or more, a yield ratio of 70% or more, a total elongation of 26.5% or more, and a hole expansion ratio of 60% or more.

The invention claimed is:

1. A high-strength cold-rolled steel sheet with high yield ratio having excellent formability, having a chemical composition containing 0.05% to 0.15% C, 0.10% to 0.90% Si, 1.0 to 1.5% Mn, 0.005% to 0.05% P, 0.0050% or less S, 0.01% to 0.10% Al, 0.0050% or less N, and 0.010% to 0.100% Nb, on a mass basis, the balance being Fe and unavoidable impurities, the high-strength cold-rolled steel sheet containing Nb-containing precipitates having an average grain size of 0.10 μm or less, and having a microstructure which is a multi-phase structure containing 90% or more of a ferrite phase and 0.5% to less than 5.0% of a martensite phase on a volume fraction basis, the remainder being low-temperature transformation phases, and the high-strength cold-rolled steel sheet having a yield, ratio of 70% or more.

2. The high-strength cold-rolled steel sheet according to claim 1, further containing at least one selected from the group consisting of 0.10% or less V and 0.10% or less Ti on a mass basis instead of a portion of the Fe component.

3. The high-strength cold-rolled steel sheet according to claim 1, further containing at least one selected from the group consisting of 0.50% or less Cr, 0.50% or less Mo, 0.50% or less Cu, 0.50% or less Ni, and 0.0030% or less B on a mass basis instead of a portion of the Fe component.

4. The high-strength cold-rolled steel sheet according to claim 1, having a tensile strength of 590 MPa or more.

5. The high-strength cold-rolled steel sheet according to claim 2, further containing at least one selected from the group consisting of 0.50% or less Cr, 0.50% or less Mo, 0.50% or less Cu, 0.50% or less Ni, and 0.0030% or less B on a mass basis instead of a portion of the Fe component.

6. A method for producing the high-strength cold-rolled steel sheet with high yield ratio having excellent formability of claim 1, the method comprising:

hot-rolling a steel slab having a chemical composition containing 0.05% to 0.15% C, 0.10% to 0.90% Si, 1.0 to 1.5% Mn, 0.005% to 0.05% P, 0.0050% or less S, 0.01% to 0.10% Al, 0.0050% or less N, and 0.030% to 0.100% Nb, on a mass basis, the balance being Fe and unavoidable impurities, at a hot-rolling start temperature of 1,150° C. to 1,270° C. and a finishing delivery temperature of 830° C. to 950° C. to manufacture a hot-rolled steel sheet;

cooling the hot-rolled steel sheet;

then coiling the hot-rolled steel sheet in a temperature range of 450° C. to 650° C.;

pickling the hot-rolled steel sheet;

then cold rolling the hot-rolled steel sheet into a cold-rolled steel sheet;

then annealing the cold-rolled steel sheet, wherein heating is performed to a first heating temperature In a temperature range of 710° C. to 820° C. at a first average heating rate of 3° C./s to 30° C./s, soaking is performed at the first heating temperature for a soaking time of 30 s to 300 s, then cooling is performed to a first cooling temperature in a temperature range of 400° C. to 600° C. at a first average cooling rate of 3° C./s to 2.5° C./s, and then cooling is performed from the first cooling temperature to a room temperature at a second average cooling rate of 3° C./s or less; and then temper-rolling the cold-rolled steel sheet with an elongation of 0.3% to 2.0%.

7. The method according to claim 6, wherein the cooling subsequent to hot rolling is performed prior to coiling in such a manner that cooling is started within a first cooling time of 1 s after the end of hot rolling, rapid cooling to a second cooling temperature in a temperature range of 650° C. to 750° C. is performed at a third average cooling rate of 20° C./s or more, and air cooling is performed in a temperature range from the second cooling temperature to 650° C. for a second cooling time of 2 s or more.

8. The method according to claim 6, wherein at east one selected from the group consisting of 0.10% or less V and 0.10% or less Ti are further contained on a mass basis instead of a portion of the Fe component.

9. The method according to claim 6, wherein one or more selected from the group consisting, of 0.50% or less Cr, 0.50% or less Mo, 0.50% or less Cu, 0.50% or less Ni, and 0.0030% or less B are further contained on a mass basis instead of a portion of the Fe component.

10. The method according to claim 8, wherein one or more selected from the group consisting of 0.50% or less Cr, 0.50% or less Mo, 0.50% or less Cu, 0.50% or less Ni, and 0.0030% or less B are further contained on a mass basis instead of a portion of the Fe component.

* * * * *